US011330947B2

(12) United States Patent
Hyun et al.

(10) Patent No.: US 11,330,947 B2
(45) Date of Patent: May 17, 2022

(54) CYCLONE TYPE DUST COLLECTOR AND CLEANER HAVING THE SAME

(71) Applicant: LG ELECTRONICS INC., Seoul (KR)

(72) Inventors: Kietak Hyun, Seoul (KR); Changgun Lee, Seoul (KR); Seungyeop Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 360 days.

(21) Appl. No.: 16/353,902

(22) Filed: Mar. 14, 2019

(65) Prior Publication Data

US 2019/0282050 A1 Sep. 19, 2019

(30) Foreign Application Priority Data

Mar. 14, 2018 (KR) ..... 10-2018-0029778

(51) Int. Cl.
*A47L 9/16* (2006.01)
*A47L 9/28* (2006.01)

(52) U.S. Cl.
CPC ..... *A47L 9/1608* (2013.01); *A47L 9/1691* (2013.01); *A47L 9/2826* (2013.01); *A47L 2201/06* (2013.01)

(58) Field of Classification Search
CPC ..... A47L 9/16; A47L 9/1608; A47L 9/1616; A47L 9/1625; A47L 9/1641;
(Continued)

(56) References Cited

U.S. PATENT DOCUMENTS 7,488,362 B2 * 2/2009 Jeong ..... A47L 9/1625 55/337
2007/0011997 A1 * 1/2007 Han ..... A47L 9/19 55/337

(Continued)

FOREIGN PATENT DOCUMENTS

EP 1797809 6/2007
JP 3854215 12/2006

(Continued)

OTHER PUBLICATIONS

Taiwanese Office Action dated Dec. 20, 2019 issued in TW Application No. 108108703.

(Continued)

*Primary Examiner* — Joseph J Hail
*Assistant Examiner* — Timothy Brady
(74) *Attorney, Agent, or Firm* — Ked & Associates LLP

(57) ABSTRACT

A cyclone type dust collector includes a first cyclone comprising a first cyclone body configured to induce a cyclonic flow of air around a first flow axis extending in a vertical direction, a first air inlet formed in the first cyclone body, a first dust outlet formed in the first cyclone body, and a first air outlet formed in the first cyclone body; and a first dust container configured to communicate with the first dust outlet and collect dust separated from the air, wherein at least a part of the first cyclone body is horizontally adjacent to the first dust container in a first horizontal direction that intersects with the first flow axis.

10 Claims, 11 Drawing Sheets

(58) Field of Classification Search
CPC ..... A47L 9/1683; A47L 9/1691; B01D 45/12; B01D 45/16; B04C 5/04; B04C 5/13; B04C 5/185; B04C 5/187; B04C 5/24; B04C 5/26; B04C 9/00; B04C 2009/005
USPC ..... 15/352, 353
See application file for complete search history.

(56) References Cited

U.S. PATENT DOCUMENTS

| | | | | |
|---|---|---|---|---|
| 2007/0079583 | A1* | 4/2007 | Oh | A47L 9/1608 55/345 |
| 2007/0084160 | A1* | 4/2007 | Kim | B01D 45/12 55/345 |
| 2007/0137153 | A1* | 6/2007 | Oh | A47L 9/1683 55/385.1 |
| 2008/0184893 | A1* | 8/2008 | Oh | A47L 9/1666 96/416 |
| 2008/0264007 | A1* | 10/2008 | Oh | A47L 9/20 55/304 |
| 2010/0224073 | A1* | 9/2010 | Oh | A47L 9/1666 96/416 |
| 2013/0305483 | A1 | 11/2013 | Dyson et al. | |

FOREIGN PATENT DOCUMENTS

| | | |
|---|---|---|
| JP | 6214606 | 10/2017 |
| KR | 10-0351843 | 9/2002 |
| KR | 10-2002-0085478 | 11/2002 |
| KR | 10-2006-0031417 | 4/2006 |
| KR | 10-0594581 | 6/2006 |
| KR | 10-1065968 | 9/2011 |
| KR | 10-0778125 | 11/2017 |
| TW | 201713261 | 4/2017 |
| WO | WO 00/36968 | 6/2000 |

OTHER PUBLICATIONS

Korean Notice of Allowance dated Oct. 30, 2019 issued in KR Application No. 10-2018-0029778.
Korean Office Action dated Mar. 28, 2019 issued in KR Application No. 10-2018-0029778.
International Search Report dated Jul. 10, 2019 issued in International Application No. PCT/KR2019/002949.
European Search Report dated Dec. 10, 2021 issued in Application No. 19768600.9.

* cited by examiner

CYCLONE TYPE DUST COLLECTOR AND CLEANER HAVING THE SAME

CROSS-REFERENCE TO RELATED APPLICATION

This application claims priority under 35 U.S.C. § 119 to Korean Application No. 10-2018-0029778 filed on Mar. 14, 2018, whose entire disclosure is hereby incorporated by reference.

BACKGROUND

1. Field

A cyclone type dust collector and a cleaner having a cyclone are disclosed herein.

2. Background

Robots have been developed for industrial use and have been a part of factory automation. In recent years, the application field of robots has been expanded to include medical robots, aerospace robots, and household robots that may be used in ordinary homes, for example. An example of a mobile robot used at home may be a robot cleaner.

Such a mobile robot may have a rechargeable battery and may be able to travel on its own by using an obstacle sensor that may allow the robot to avoid an obstacle during traveling. In recent years, apart from merely traveling autonomously to perform cleaning, mobile robots have been actively researched for utilization in various fields such as health care, smart home, remote control, and the like.

In Korean Patent Laid-Open No. 10-2002-0085478, a cyclone type dust collector used in a cleaner includes a cyclone body that induces a cyclone flow around a flow axis, and a dust container provided below the cyclone body to be overlapped with the flow axis of the cyclone body. The dust container is located below the cyclone body, and collects the dust in the dust container due to the weight of the dust.

However, such a cyclone type structure may increase the overall height of the robot cleaner, which may prevent the robot cleaner from entering a space between a floor surface and the bottom of furniture. Therefore, the related art cleaner has a cyclone type dust collector having a high height, so that it is difficult to clean the space between the floor surface and the bottom of furniture.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
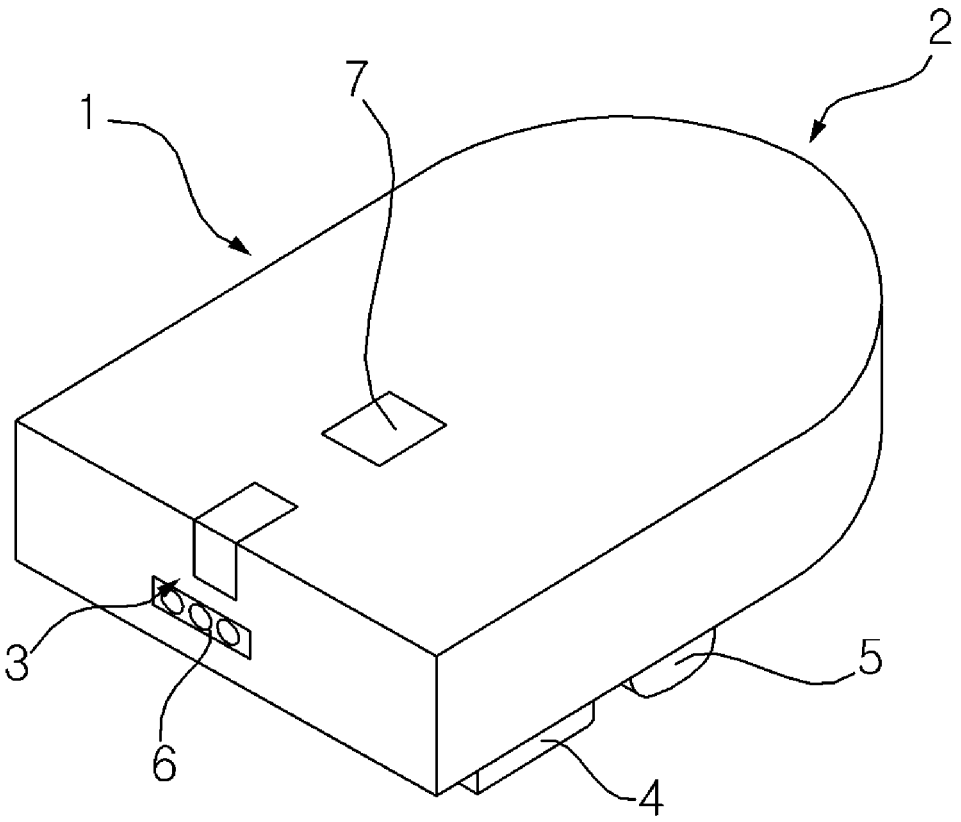
FIG. 1 is a perspective view illustrating a cleaner according to an embodiment of the present disclosure.
Figure 2:
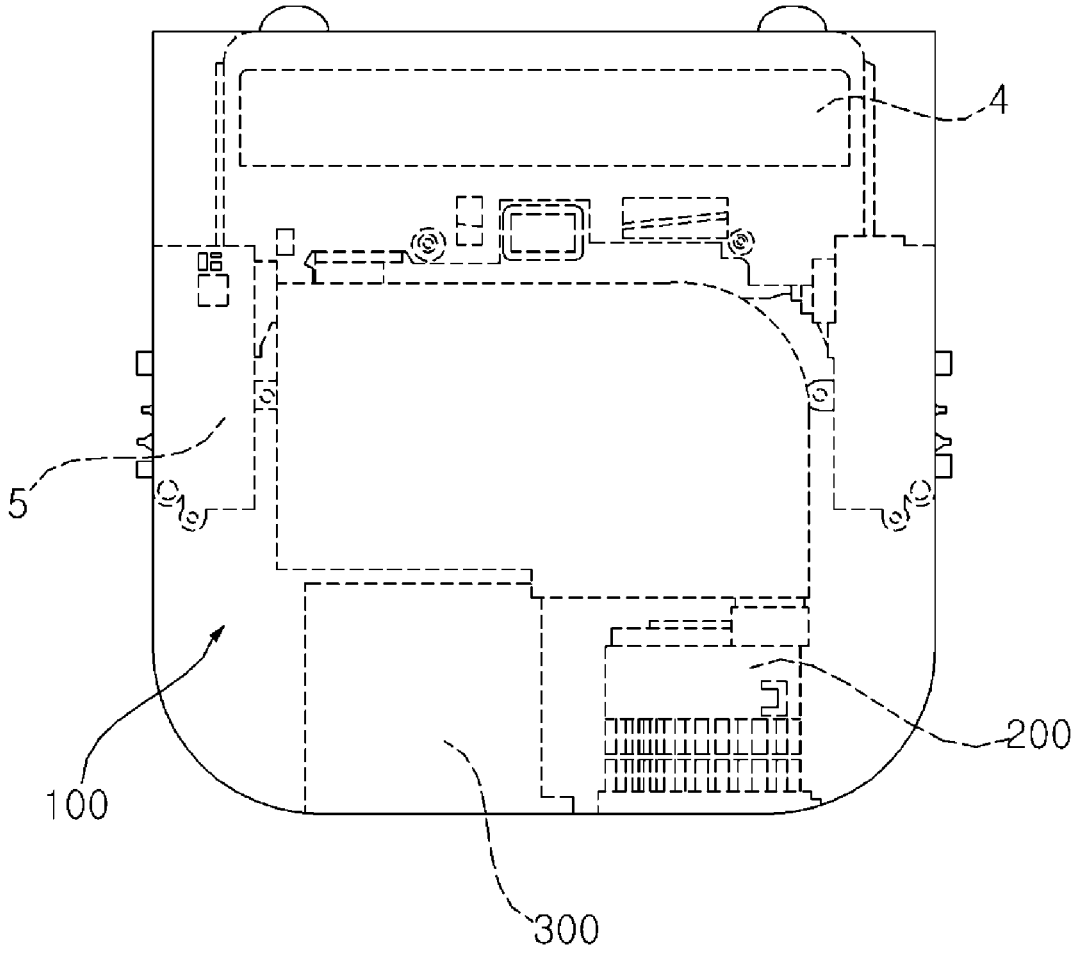
FIG. 2 is a plan view of the cleaner of FIG. 1.
Figure 3:
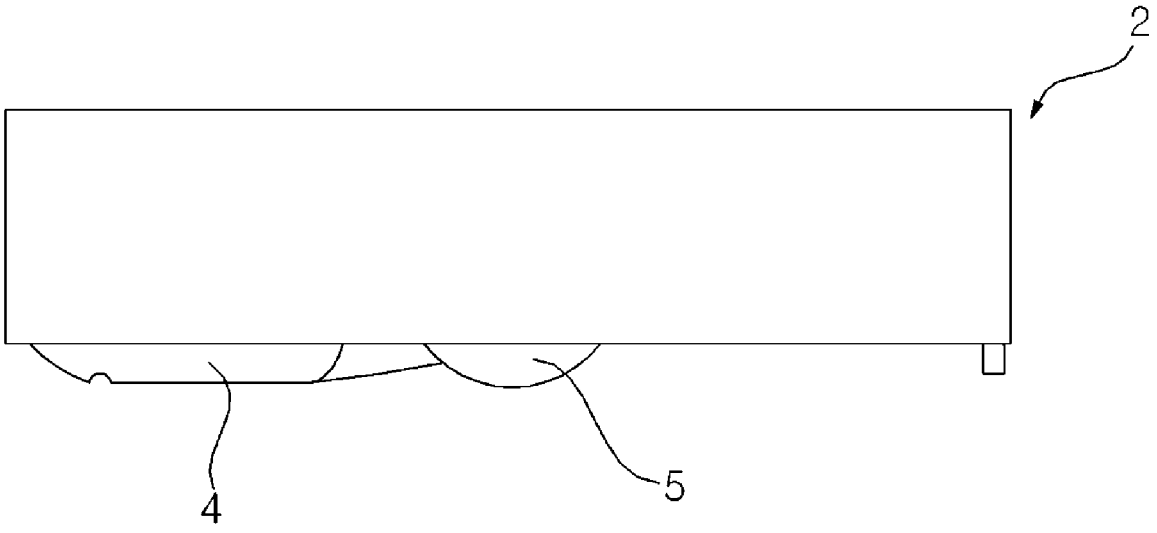
FIG. 3 is a side view of the cleaner of FIG. 1.

Referring to FIGS. 1 to 3, a cleaner 1 may include a cleaner main body 2, a cleaning nozzle 4, a sensing unit (or sensor) 6, and a cyclone type dust collector. The cleaner main body 2 may include a controller that controls the cleaner 1 and various mounted or installed components. The cleaner main body 2 may form a space in which various components forming the cleaner 1 are accommodated.

The cleaner main body 2 may travel in one of an automatic mode and a manual mode as selected by a user. The cleaner main body 2 may include a mode selection input unit (or input button) 7 that enables the user to select one of the automatic mode and the manual mode. When the user selects the automatic mode, the cleaner main body 2 may automatically travel like a robot cleaner. Further, when the user selects the manual mode, the cleaner main body 2 may be manually driven by dragging or pushing by the force of the user.

The cleaner main body 2 may include a wheel unit (or wheel) 5 which allows the cleaner main body 2 to move. The wheel 5 may include a motor and at least one wheel rotated by the driving force of the motor. The rotation direction of the motor may be controlled by the controller, so that the driven wheel may be configured to be rotatable in a first direction or a second direction.

The wheel 5 may be provided at both left and right sides of the cleaner main body 2. The cleaner main body 2 may be moved forward or backward and leftward or rightward by the wheel 5, or may be rotated. Each of the wheels 5 may be configured to be drivable independently of each other. To this end, each wheel 5 may be driven by a different motor.

The controller may control the drive of the wheel 5, so that the cleaner 1 autonomously travel the floor. The wheel 5 may be provided at a lower portion of the cleaner main body 2 to move the cleaner main body 2. The wheel 5 may include only circular wheels, may be configured by connecting circular rollers by a belt chain, or may be configured by combining the circular wheels with circular rollers connected by a belt chain. An upper portion of the wheel 5 may be located inside the cleaner main body 2 and a lower portion thereof may protrude to a lower side of the cleaner main body 2. The wheel 5 may be in contact with a floor surface which is a surface to be cleaned, thereby enabling the cleaner main body 2 to travel.

The wheel unit 5 may be installed in or at the left or first and right or second sides of the cleaner main body 2, respectively. The wheel 5 provided at the first side of the cleaner main body 2 and the wheel 5 provided at the second side of the cleaner main body 2 may be driven independently of each other. For example, the wheel 5 provided at the first side of the cleaner main body 2 may be connected through at least one first gear, and may be rotated by a driving force of a first traveling motor that rotates the first gear. In addition, the wheel 5 provided at the second side of the cleaner main body 2 may be connected through at least one second gear, and may be rotated by a driving force of a second traveling motor that rotates the second gear.

The controller may determine a traveling direction of the cleaner main body 2 by controlling the rotation speed of a rotation shaft of each of the first traveling motor and the second traveling motor. For example, when the rotation shafts of the first traveling motor and the second traveling motor are simultaneously rotated at the same speed in the same direction, the cleaner main body 2 may go straight.

In addition, when the rotation shafts of the first traveling motor and the second traveling motor are simultaneously rotated at different speeds in the same direction, the cleaner main body 2 may be turned to the left or right. The controller may drive one of the first traveling motor and the second traveling motor and stop the other so as to turn the cleaner main body 2 to the left or right.

A suspension unit (or suspension) may be installed inside the cleaner main body 2. The suspension may include a coil spring. The suspension may absorb impact and vibration transmitted from the wheel 5 by using the elastic force of the coil spring when the cleaner main body 2 travels.

Further, an elevating unit (or lifter) that adjusts the height of the cleaner main body 2 may be installed in the suspension. The lifter may be vertically movably installed in the suspension and may be coupled to the cleaner main body 2. Therefore, when the lifter is moved upward from the suspension, the cleaner main body 2 may be moved upward together with the lifter. When the lifter is moved downward from the suspension, the cleaner main body 2 may be moved downward together with the lifter. The cleaner main body 2 may be vertically moved by the lifter to adjust the height of the cleaner 1.

When the cleaner main body 2 travels on a hard floor surface, the wheel 5 may move and the floor surface may be cleaned when the bottom surface of the cleaning nozzle 4 is in contact with the floor surface. However, when a carpet is laid on the floor surface to be cleaned, slip may occur in the wheel 5, so that the traveling performance of the cleaner main body 2 may be deteriorated. Further, the traveling performance of the cleaner main body 2 may be deteriorated due to the force of the carpet in the cleaning nozzle 4.

However, since the lifter may adjust the height of the cleaner main body 2 according to the slip ratio of the wheel 5, the degree to which the bottom surface of the cleaning nozzle 4 is in contact with the surface to be cleaned may be adjusted, so that the traveling performance of the cleaner main body 2 may be maintained regardless of the material of the surface to be cleaned.

When the wheel 5 provided at the first side of the cleaner main body 2 is connected to the first traveling motor through the first gear, and the wheel 5 provided at the second side of the cleaner main body 2 is connected to the second traveling motor through the second gear, if the user desires to drive the cleaner main body 2 in the manual mode when the first traveling motor and the second traveling motor are stopped, each of the first and second wheels 5 may not be able to be rotated.

Therefore, in the manual mode of the cleaner main body 2, the connection of the first and second wheels 5 and the first and second traveling motors may be released. A clutch may be provided inside the cleaner main body 2 to connect the first and second wheels 5 with the first and second traveling motors in the automatic mode of the cleaner main body 2, and disconnect the first and second wheels 5 with the first and second traveling motors in the manual mode of the cleaner main body 2.

The cleaner main body 2 may include a battery 300 that supplies power to the electrical components of the cleaner 1. The battery 300 may be chargeable and may be detachable from the cleaner main body 2.

The battery 300 may overlap with the cyclone type dust collector described later in the horizontal direction (left-right direction LeRi) or the front-rear direction (FR) so as to implement the cleaner to be slim. The height of the battery 300 may be equal to or smaller than the height of the cyclone type dust collector.

The cleaner main body 2 may include a dust collector accommodating unit (or shell), and the cyclone type dust collector may be detachably coupled to the dust collector shell. The dust collector shell may be opened toward the lower side of the cleaner main body 2. The dust collector shell may be formed in or at other positions (for example, behind the cleaner main body 2), depending on the type of the cleaner. The cyclone type dust collector may be detachably coupled to the dust collector shell.

The cyclone type dust collector may include an inlet (first air inlet) through which a dust-containing air is introduced and an outlet through which a dust-separated air may be exhausted. An intake flow path formed inside the cleaner main body 2 may correspond to a flow path ranging from the cleaning nozzle 4 to the inlet of the cyclone type dust collector, and a discharge flow path may correspond to a flow path ranging from the outlet of the cyclone type dust collector to a discharge port.

According to such a configuration, the air containing the dust introduced through the cleaning nozzle 4 may flow into the cyclone type dust collector via the intake flow path inside the cleaner main body 2, and the air and the dust may be separated from each other in the cyclone type dust collector. The dust may be collected in the dust container 190, and the air may be discharged from the dust container 190, and then finally discharged to an outside of the cleaner 1 through the discharge port via the discharge flow path inside the cleaner main body 2.

The cleaner main body 2 may include a lower cover that covers the sensor 6 accommodated in the dust collector shell. The lower cover may be hingedly connected to one side of the cleaner main body 2 to be rotatable. The lower cover may cover the opened lower side of the dust collector shell and cover the lower side of the cyclone type dust collector. In addition, the lower cover may be configured to be detachable from the cleaner main body 2.

A photographing unit (or camera) 3 may be provided in the cleaner main body 2, and may photograph an image to simultaneous localization and mapping (SLAM) of the cleaner. The image photographed by the camera 3 may be used to generate a map of traveling area or to detect the current position in the traveling area.

The camera 3 may generate three-dimensional coordinate information related to the surroundings of the cleaner main body 2. For example, the camera 3 may be a 3D depth camera that calculates a distance between the cleaner 1 and an object to be photographed. Accordingly, field data for three-dimensional coordinate information may be generated.

Specifically, the camera 3 may photograph a two-dimensional image related to the surroundings of the cleaner main body 2, and may generate a plurality of three-dimensional coordinate information corresponding to the photographed two-dimensional image.

In one embodiment, the camera 3 may include two or more cameras that acquire an existing two-dimensional image, so that it may achieve a stereoscopic vision scheme that generates three-dimensional coordinate information by combining two or more images obtained from two or more cameras. Specifically, the camera 3 according to the embodiment may include a first pattern irradiating unit that irradiates light of a first pattern downward toward the front of the main body, a second pattern irradiating unit that irradiates light of a second pattern upward toward the front of the main body 2, and an image acquiring unit that acquires an image of the front of the main body. Thus, the image acquiring unit may acquire an image of an area to which the light of the first pattern and the light of the second pattern are input.

In another embodiment, the camera 3 may include an infrared ray pattern emitting unit that irradiates an infrared ray pattern together with a single camera, and captures the shape of the infrared ray pattern, irradiated by the infrared ray pattern emitting unit, projected onto an object to be photographed, so that the distance between the camera 3 and the object to be photographed can be measured. Such a camera 3 may be an infra red (IR) type camera 3.

In another embodiment, the camera 3 may include a light emitting unit that emits light together with a single camera. The camera 3 may receive a part of laser, emitted from the light emitting unit, which is reflected from the object to be photographed, and analyze the received laser, so that the distance between the camera 3 and the object to be photographed can be measured. Such a camera 3 may be a time-of-flight (TOF) type camera 3.

The laser of the camera 3 as described above may irradiate a laser extended in at least one direction. In one example, the camera 3 may include first and second lasers, when the first laser may irradiate linear lasers intersected with each other, and the second laser may irradiate a single linear laser. According to this, the lowermost laser may detect the bottom of an obstacle, the uppermost laser may detect the top of an obstacle, and the intermediate laser between the lowermost laser and the uppermost laser may detect the middle of an obstacle.

The sensor 6 may be provided in the cleaner main body 2 and may detect information related to the environment in which the cleaner main body 2 is located. The sensor 6 may detect information related to the environment so as to generate field data.

The sensor 6 may detect a nearby geographic feature (including obstacles) so that the cleaner 1 does not collide with the obstacle. The sensor 6 may detect information outside of the cleaner 1. The sensor 6 may detect a user around the cleaner 1. The sensor 6 may detect an object around the cleaner 1.

In addition, the sensor 6 may be able to accomplish panning (moving to the left and right) and tilting (up and down) in order to improve the detection function of the cleaner and the traveling function of a robot cleaner. The sensor 6 may include at least one of an external signal detection sensor, an obstacle detection sensor, a cliff detection sensor, a lower camera sensor, an upper camera sensor, an encoder, a shock detection sensor, and a microphone.

The external signal detection sensor may detect an external signal of the cleaner 1. The external signal detection sensor may be, for example, an infrared ray sensor, an ultrasonic sensor, a radio frequency (RF) sensor, or the like. Thus, field data for the external signal may be generated.

The cleaner 1 may receive a guide signal generated by the charging base by using the external signal detection sensor and detect information on the position and direction of a charging base. The charging base may transmit a guide signal indicating the direction and the distance so that the cleaner 1 is able to return. For example, the cleaner 1 may receive a signal transmitted from the charging base to determine the current position, set the moving direction, and return to the charging base.

The obstacle detection sensor may detect an obstacle ahead. Thus, field data for the obstacle is generated. The obstacle detection sensor may detect an object existing in the moving direction of the cleaner 1 and may transmit a generated field data to the controller.

For example, the obstacle detection sensor may detect protrusions, house fittings, furniture, walls, wall edges, and the like existing on the moving path of the cleaner 1 and transmit the field data to the controller. The obstacle detection sensor may be, for example, an infrared sensor, an ultrasonic sensor, a RF sensor, a geomagnetic sensor, or the like. The cleaner 1 may use one type of sensor as an obstacle detection sensor or use two or more types of sensors together as needed.

The cliff sensor may detect an obstacle on the floor supporting the cleaner main body 2, by mainly using various types of optical sensors. Thus, field data for an obstacle on the floor is generated. The obstacle detection sensor may be an infrared sensor having a light emitting unit and a light receiving unit like the obstacle detection sensor, an ultrasonic sensor, an RF sensor, a position sensitive detector (PSD) sensor, or the like.

For example, the cliff detection sensor may be a PSD sensor, but it may be configured of a plurality of different types of sensors. The PSD sensor may have a light emitting unit that emits an infrared ray to an obstacle, and a light receiving unit that receives the infrared ray that is reflected and returned from the obstacle. When the obstacle is detected by using the PSD sensor, a stable measurement value may be obtained irrespective of the reflectance of the obstacle and the color difference. The controller may measure the infrared angle between a light emitting signal of the infrared ray emitted toward the ground by the cliff detection sensor and a reflection signal received after being reflected by the obstacle, and detect the cliff, thereby acquiring the field data of the depth of the cliff.

The lower camera sensor may acquire image information (field data) about the surface to be cleaned during the movement of the cleaner 1. The lower camera sensor may also be referred to as an optical flow sensor. The lower camera sensor may convert the downward image input from an image sensor provided in the sensor to generate image data (field data) of a certain format. Field data for an image recognized through the lower camera sensor may be generated.

By using the lower camera sensor, the controller may detect the position of a mobile robot irrespective of the slip of the mobile robot. The controller may compare and analyze the image data photographed by the lower camera sensor according to the time taken to calculate the moving distance and the moving direction, and calculate the position of the mobile robot based on the calculated moving distance and moving direction.

The cliff detection sensor may detect the material of the floor. The cliff detection sensor may detect the reflectance of the light reflected from the floor, and the controller may determine the material of the floor according to the reflectance. For example, if the material of the floor is a marble having a high reflectance, the reflectance of the light detected by the cliff detection sensor is high. If the material of the floor is a wood, a floor paper, a carpet, and the like having a relatively low reflectance, the reflectance of the light detected by the cliff detection sensor is relatively low. Therefore, the controller may determine the material of the floor by using the reflectance of the floor detected by the cliff detection sensor, and may determine that the floor is a carpet when the reflectance of the floor is a set reflectance.

In addition, the cliff detection sensor may detect the distance to the floor, and the controller may detect the material of the floor according to the distance to the floor. For example, if the cleaner is located on a carpet on the floor, the distance to the floor detected by the cliff detection sensor may be detected to be shorter than the case where the cleaner is located on a floor not carpeted. Therefore, the controller may determine the material of the floor by using the distance to the floor detected by the cliff sensor. If the distance to the floor is equal to or greater than a set distance, the floor may be determined as a carpet.

A floor detection sensor may be a camera sensor, a current sensor, and the like, in addition to the cliff detection sensor. The camera sensor may photograph the floor, and the controller may analyze the image photographed by the camera sensor to determine the material of the floor. The controller may set images corresponding to the material of the floor, and the controller may determine the material of the floor as a material corresponding to a set image when the set image is included in the image photographed by the camera sensor. If the set image corresponding to the image of the carpet is included in the image, the controller may determine that the material of the floor is a carpet.

The current sensor may detect the current resistance value of the wheel drive motor, and the controller may determine the material of the bottom according to the current resistance value detected by the current sensor. For example, when the cleaning nozzle 4 is located on the carpet placed on the floor, the wool of the carpet may be sucked through a suction port of the cleaning nozzle 4 to interrupt the traveling of the cleaner.

A current resistance due to load may thus occur between a rotor of a wheel drive motor and a stator. The current sensor may detect the current resistance value generated by the wheel drive motor, and the controller may determine the material of the floor according to the current resistance value. If the current resistance value is equal to or greater than the set value, the controller may determine the material of the floor as carpet.

The upper camera sensor may face the upper side or the front side of the cleaner 1, and may photograph the vicinity of the cleaner 1. When the cleaner 1 has a plurality of upper camera sensors, the camera sensors may be formed in the upper portion or on the side surface of the mobile robot at a certain distance or a certain angle. Field data for an image recognized through the upper camera sensor may be generated. The encoder may detect information related to the operation of the motor that drives the wheel 5. Thus, field data for the operation of the motor may be generated.

The shock detection sensor may detect a shock when the cleaner 1 collides with an external obstacle or the like. Thus, field data for an external shock may be generated. The microphone may detect an external sound. Accordingly, field data for an external sound may be generated.

The sensor 6 may include an image sensor. The field data may be image information acquired by the image sensor or feature point information extracted from the image information, but it is not necessarily limited thereto.

The cleaning nozzle 4 may suck the air-containing dust or may wipe the floor. Here, the cleaning nozzle 4 that sucks the dust-containing air may be referred to as a suction module, and the cleaning nozzle 4 that wipes the floor may be referred to as a mop module.

The cleaning nozzle 4 may be detachably coupled to the cleaner main body 2. When a suction module is detached from the cleaner main body 2, the mop module may be detachably coupled to the cleaner main body 2 in place of the detached suction module. Accordingly, when a user desires to remove the dust on the floor, the suction module may be mounted in the cleaner main body 2, and when the user desires to clean the floor, the mop module may be mounted in the cleaner main body 2.

The cleaning nozzle 4 may be configured to have a function of cleaning the floor after sucking the air-containing dust. The cleaning nozzle 4 may be provided at a lower portion of the cleaner main body 2, or may protrude from one side of the cleaner main body 2 as shown in the drawing. A first side may be a side in which the cleaner main body 2 travels in a forward direction, for example, the front side of the cleaner main body 2. The cleaning nozzle 4 may be provided at a forward side F of the wheel 5.

The main body 2 may further include a suction force generating unit (or suction fan) 200 that generates a suction force. The suction fan 200 may include a motor housing and a suction motor accommodated inside the motor housing.

At least a portion of the suction motor may overlap with a first dust container of the cyclone type dust collector in a horizontal direction. The suction motor may be located at the lateral side of the cyclone type dust collector.

An impeller may be coupled to a rotation shaft of the suction motor. When the suction motor is driven and the impeller is rotated together with the rotation shaft, the impeller may generate a suction force.

An intake flow path may be formed inside the cleaner main body 2. Foreign matter such as dust may be introduced into the cleaning nozzle 4 from the surface to be cleaned due to the suction force generated by the driving force of the suction motor, and the foreign matter introduced into the cleaning nozzle 4 may be introduced into the intake flow path.

The cleaning nozzle 4 may clean the floor surface to be cleaned when the cleaner main body 2 travels in the automatic mode. The cleaning nozzle 4 may be adjacent to the floor surface of the front surface of the cleaner main body 2. A suction port through which air is sucked may be formed in the bottom surface of the cleaning nozzle 4. The suction port may be pointed toward the floor surface when the cleaning nozzle 4 is coupled with the cleaner main body 2.

The cleaning nozzle 4 may be coupled to the cleaner main body 2 via a gantry. The cleaning nozzle 4 may communicate with the intake flow path of the cleaner main body 2 via a cable adapter.

The cleaning nozzle 4 may include a case having a suction port formed in a bottom surface portion thereof, and a brush unit (or brush) may be rotatably provided in the case. The case may provide an empty space so that the brush may be rotatably installed therein. The brush may include a rotation shaft extending to the left and right and a plurality of bristles protruding from the outer circumference of the rotation shaft. The rotation shaft of the brush may be rotatably coupled to the left and right side surfaces of the case.

The brush may be arranged such that a lower portion of the brush protrudes through the suction port formed in the bottom of the case. When the suction motor is driven, the brush may be rotated by a suction force and may sweep dust and other foreign matter upward from the floor surface to be cleaned. The foreign matter swept upward may be sucked into the case by the suction force. The brush may be formed of a material that does not generate frictional electricity so that foreign matter may not easily adhere thereto.

When the cleaner has a high height, if a space between the furniture and the floor surface has a low height, the cleaner may not be able to enter into the space, so that the space may not be cleaned by the cleaner. In order to solve such a problem, the cyclone type dust collector according to an embodiment may have a low-height configuration.

Referring to FIGS. 4 to 7, the cyclone type dust collector according to an embodiment may include at least one cyclone and at least one dust container. For example, the cyclone type dust collector 100 according to an embodiment may include a first cyclone 110 and a first dust container 190.

The first cyclone 110 may induce a cyclonic flow of introduced air around a flow axis extending in the vertical direction. The flow axis of the first cyclone 110 may be defined as a first flow axis A1.

The first cyclone 110 may communicate with a first dust container 190. The air and the dust sucked through the first cyclone 110 may spirally flow along a circumferential surface 112*a* of the first cyclone 110.

The first cyclone 110 may include a first cyclone body 112 that generates a cyclonic flow around the first flow axis A1 extending in the vertical direction, a first air inlet 111 formed in the first cyclone body 112, a first dust outlet 115 formed in the first cyclone body 112, and a first air outlet 113 formed in the first cyclone body 112. The first cyclone body 112 may have a shape that generates a cyclonic flow around the first flow axis A1 extending in the vertical direction. The first cyclone body 112 may have various shapes such as a cylinder, an elliptical pillar, a cone, and the like, for example.

For example, the first cyclone body 112 may surround the first flow axis A1, and may include a circumferential surface 112*a* having opened upper and lower ends, an upper cover 112*b* covering an upper portion of the circumferential surface 112*a*, and a lower cover 112*c* covering a lower portion of the circumferential surface 112*a*. The circumferential surface 112*a* may define a circular or elliptical orbit based on the first flow axis A1 when viewed from above. The inner space defined by the circumferential surface 112*a*, the upper cover 112*b*, and the lower cover 112*c* may be a flow space 112*d* through which the sucked air spirally flows.

The lower cover 112*c* may cover the lower portion of the circumferential surface 112*a*. In order to arrange the first dust container 190 to be overlapped with the first cyclone body 112 in the horizontal direction, the air-containing dust may be introduced from the lower portion of the first cyclone body 112. The lower cover 112*c* may have a flat shape, but may have a shape that can rotate the air introduced from the first air inlet 111 while raising the air.

The respective areas of the lower cover 112*c* may have a stepped portion, or the lower cover 112*c* may define a part of a spiral orbit having the first flow axis A1 as a central axis. The area excluding a central portion of the lower cover 112*c* may be a spiral plate.

The upper cover 112*b* may cover the upper portion of the circumferential surface 112*a*. Since the upper cover 112*b* does not affect the spiral flow of the air, it may be flat. The first air inlet 111 may be formed in the first cyclone body 112 to provide external air to the inside of the first cyclone body 112. The first air inlet 111 may communicate with the cleaning nozzle 4, so that the air sucked from the cleaning nozzle 4 flows into the first air inlet 111.

The first air inlet 111 may be formed in the circumferential surface 112*a* of the first cyclone body 112. The cyclone flow may be generated by the traveling direction of the air introduced through the first air inlet 111. The first air inlet 111 may extend in the tangential direction of the circumferential surface 112*a* of the circular orbit around the first flow axis A1. The first air inlet 111 may be implemented by a pipe having a certain length. The first air inlet 111 may extend in a direction parallel to the horizontal direction.

The first air outlet 113 may be formed in the first cyclone body 112 to discharge the air inside the first cyclone body 112 to the outside of the first cyclone body 112. The first air outlet 113 may communicate with an exhaust port or may communicate with a second cyclone 120 described later. The first air outlet 113 may communicate with a second air inlet 121 of the second cyclone 120. Therefore, the air discharged through the first air outlet 113 may be supplied to the second cyclone 120, and dust may be further separated.

The first air outlet 113 may be formed in the upper cover 112*b* connected to the upper end of the circumferential surface 112*a* of the first cyclone body 112. The first air outlet 113 may overlap with the first flow axis A1.

The first dust outlet 115 may be formed in the first cyclone body 112. The first dust outlet 115 may be a space through which the dust flows after having been separated from the air inside the first cyclone body 112. The dust separated from the first cyclone body 112 may be discharged to the outside of the first cyclone body 112 through the first dust outlet 115.

The first dust outlet 115 may be formed in the circumferential surface 112*a* of the first cyclone body 112. The first dust outlet 115 may extend in the tangential direction of the circumferential surface 112*a* of the circular orbit based on the first flow axis A1. The first dust outlet 115 may be a pipe having a certain length. The first dust outlet 115 may extend in a direction parallel to the horizontal direction.

The first dust outlet 115 may communicate with the first dust container 190. The first dust outlet 115 may be connected closely to an upper end of the first dust container 190 in order to prevent the dust supplied to the first dust container 190 through the first dust outlet 11 from flowing back to the first cyclone body 112.

The first dust container 190 may collect the dust collected in the first cyclone 110, and may communicate with the first dust outlet 115. The horizontal width or length of the first dust container 190 may be greater than its height.

The first cyclone 110 and the first dust container 190 may overlap with each other in the horizontal direction so as to reduce the height of the cyclone type dust collector 100. The first dust container 190 may be provided outside of the first cyclone 110. When the first dust container 190 does not overlap with the first cyclone 110 in the direction of the first flow axis A1, but overlaps with the first cyclone 110 in the horizontal direction, the height of the cleaner may be reduced, so that it may be easy to clean a space having a low height.

At least a part of the first cyclone body 112 may overlap with the first dust container 190 in a first direction intersected with the first flow axis A1. The first direction may be a front-rear direction. At least a part of the first cyclone body 112 may overlap with the first dust container 190 in the left and right direction intersected with the first flow axis A1.

The first cyclone body 112 may completely overlap with the first dust container 190 in the first direction. The height of the first cyclone body 112 may be smaller than the height of the first dust container 190. When the first cyclone body 112 and the first dust container 190 are arranged in the horizontal direction, it may be difficult to collect dust by gravity.

To solve this problem, the first air inlet 111 may be arranged below the first dust outlet 115 and the first air outlet 113 may be provided above the first air inlet 111. The first air inlet 111 may be provided below the circumferential surface 112*a* of the first cyclone body 112, and the first dust outlet 115 may be provided in a relatively upper portion of the first air inlet 111 in the circumferential surface 112*a* of the first cyclone body 112.

Thus, air may be supplied through the first air inlet 111 located in the lower portion of the first cyclone body 112. The air supplied through the first air inlet 111 may perform a spiral movement of rotating while moving upward in the first cyclone body 112, so that the dust is separated. The separated dust may be collected in the first dust container 190 through the first dust outlet 115 located in or at the upper portion of the first cyclone body 112. The dust-separated air may be discharged through the first air outlet 113. Since the first air outlet 113 and the first dust outlet 115 are provided above the first air inlet 111, the dust may be effectively collected.

The first cyclone 110 may further include a mesh cone (or particle trap) 130 configured to remove large foreign matter or dust from the air discharged from the first cyclone 110. The mesh cone 130 may be provided between the inside of the first cyclone body 112 and the first air outlet 113. The mesh cone 130 may isolate the first air outlet 113 and the inside of the first cyclone body 112. The mesh cone 130 may have a cone or cylindrical shape extending from the rim of the first air outlet 113 into the interior of the first cyclone body 112.

A plurality of through holes may be formed in the mesh cone 130. The size of the filtered foreign matter may be determined by the size of the through holes. The mesh cone 130 may prevent large dust or particles from flowing into the second cyclone 120 which may collect small dust so that the second cyclone 120 may not be clogged with the large dust or particles.

The cyclone type dust collector 100 may further include the second cyclone 120 configured to separate further dust from the air discharged from the first cyclone 110. The second cyclone 120 may be smaller than the first cyclone 110 and may collect smaller dust in comparison with the first cyclone 110. A number of second cyclones 120 may be equal to a number of first cyclones 110 or a larger number of second cyclones 120 may be provided. At least two second cyclones 120 may be provided.

The second cyclone 120 may perform a cyclonic flow on air discharged from the first cyclone 110 about a second flow axis A2 extending in a vertical direction. The second cyclone 120 may include an axial flow, a swirl pipe, a tangential inlet type, and the like. For example, the second cyclone may include a second cyclone body 122 that generates a cyclonic flow about a vertically extending flow axis, a second air inlet 121 formed in the second cyclone body 122, a second dust outlet 125 formed in the second cyclone body 122, and a second air outlet 123 formed in the second cyclone body 122.

The second cyclone body 122 may have a shape that generates a cyclonic flow around the second flow axis A2 extending in the vertical direction. The second cyclone body 122 may have various shapes such as a cylinder, an elliptical pillar, a cone, and the like, for example. The second cyclone body 122 may have a cylindrical shape having an inner diameter of a lower end smaller than an inner diameter of an upper end.

For example, the second cyclone body 122 may surround the second flow axis A2, and upper and lower portions may be opened. The opened upper portion of the second cyclone body 122 may be defined as a second air outlet 123 and the opened lower portion of the second cyclone body 122 may be defined as a second dust outlet 125.

The circumferential surface 112*a* may define a circular or elliptical orbit or path based on the second flow axis A2 when viewed from above. An inner space defined by the circumferential surface 112*a*, the upper cover 112*b*, and the lower cover 112*c* may be defined as the flow space 112*d* in which the sucked air spirally flows.

The second air inlet 121 may be formed in the second cyclone body 122 to provide the air discharged from the first cyclone 110 to the interior of the second cyclone body 122. The second air inlet 121 may communicate with the first air outlet 113. The first air outlet 113 and the second air inlet 121 may be connected through a connection space 135 of the upper portion of the upper cover 112*b* of the first cyclone 110. The second air inlet 121 may be defined as a space between the rim of the second air outlet 123 and the second cyclone body 122.

The second air inlet 121 may be formed in the second cyclone body 122. The second air inlet 121 may horizontally penetrate the second cyclone body 122. The cyclonic flow may be generated by the traveling direction of the air introduced through the second air inlet 121. The second air inlet 121 may extend in a tangential direction to a circular orbit or path around the second flow axis A2. The second air inlet 121 may have the form of a pipe having a certain length. The second air inlet 121 may extend in a direction parallel to the horizontal direction.

The second air inlet 121 may be formed in or at the upper portion of the second cyclone body 122. The second air inlet 121 may be located higher than the upper end of the first cyclone body 112 in order to restrict the inflow of large dust from the first cyclone 110.

The second air inlet 121 may be located higher than the first air outlet 113, the first dust outlet 115, and the first air inlet 111. The second air inlet 121 may be provided above the second dust outlet 125 and the second air inlet 121 may be provided above the second air outlet 123. The air introduced into the second cyclone body 122 through the second air inlet 121 may be discharged to the outside of the second cyclone body 122 after the dust is sufficiently separated from the air.

The second air outlet 123 may be formed in the second cyclone body 122 to discharge the air inside the second cyclone body 122 to the outside of the second cyclone body 122. The second air outlet 123 may communicate with the exhaust port.

The second air outlet 123 may be formed in or at the upper portion of the second cyclone body 122. As another example, in the second air outlet 123, the lower end of a discharge pipe 123*a* connected to the exhaust port may be located in or at a position lower than the upper end of the second cyclone body 122 having opened upper and lower sides, and at least a portion of the discharge pipe 123*a* may be located inside the second cyclone body 122.

The second air outlet 123 may be located lower than the second air inlet 121 and may be located higher than the second dust outlet 125. The second air inlet 121 may be defined as a space between the upper end of the second cyclone body 122 and an outer surface of the discharge pipe 123*a*. The center of the second air outlet 123 may overlap with the second flow axis A2.

A space between the outer circumferential surface of the discharge pipe 123*a* and the inner circumferential surface of the second cyclone body 122 may be defined as a swirling space 128 in which the inflow air spirals. A guide vane 126 configured to guide the air introduced from the second air inlet 121 may be provided within the swirling space 128.

The guide vane 126 may be connected to the second cyclone body 122 to guide the air introduced from the second air inlet 121. The guide vane 126 may form at least a part of a spiral orbit or flow space around a flow axis of the second cyclone body 122. A first end of the guide vane 126 may be connected to the inner circumferential surface of the second cyclone body 122 and a second end of the guide vane 126 may be connected to the outer circumferential surface of the discharge pipe 123*a*.

The second dust outlet 125 may be formed in the second cyclone body 122. The second dust outlet 125 may be a space in which the dust which is separated while the air in the second cyclone body 122 is cyclone-rotated flows. The dust separated in the second cyclone body 122 may be discharged to the outside of the second cyclone body 122 through the second dust outlet 125.

The second dust outlet 125 may penetrate the second cyclone body 122 in the vertical direction. The second dust outlet 125 may overlap with the second flow axis A2.

The second dust outlet 125 may communicate with the second dust container 129. The second dust outlet 125 may be connected to the upper end of the second dust container 129 to prevent the dust supplied to the second dust container 129 through the second dust outlet 125 from flowing back to the second cyclone body 122.

The second dust container 129 may collect the dust collected in the second cyclone 120, and may communicate with the second dust outlet 125. The second dust container 129 may be provided below the second cyclone 120. The second dust container 129 may be arranged in the second flow axis A2.

Since the second cyclone 120 separates smaller dust in comparison with the first cyclone 110, the width and height of the second cyclone 120 may be smaller than that of the first cyclone body 112. Therefore, even if the second dust container 129 is arranged below the second cyclone body 122, the height of the cleaner may not be increased.

At least a part of the second cyclone 120 and the second dust container 129 may overlap with the first dust container 190 in a first direction. At least a part of the second cyclone 120 and the second dust container 129 may overlap with the first cyclone body 112 in a second direction intersected with the first flow axis A1. The second cyclone 120 and the second dust container 129 may overlap with the first cyclone body 112 in the left-right direction, and may overlap with the first dust container 190 in the front-rear direction.

Figure 6A:
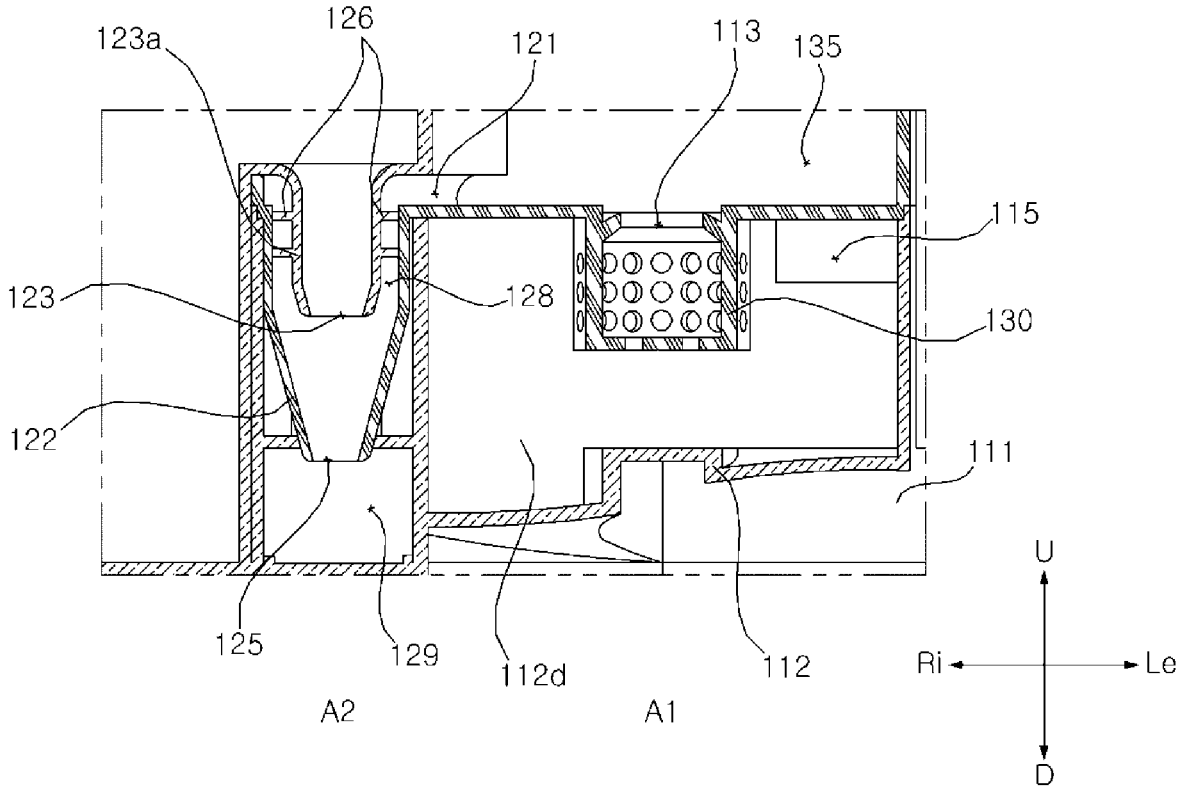
FIG. 6A is a cross-sectional view of the cyclone type dust collector of FIG. 4.
Figure 6B:
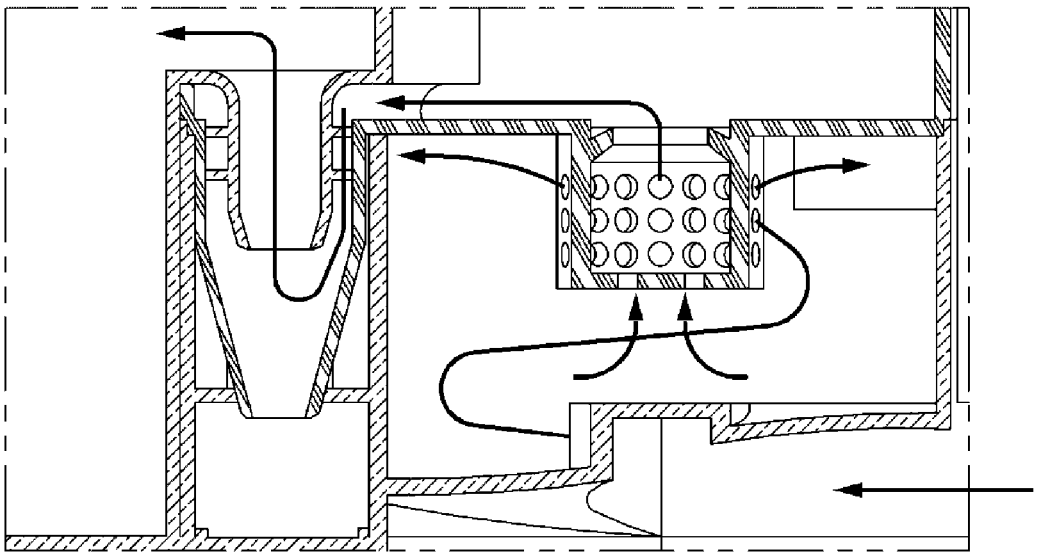
FIG. 6B illustrates a flow of air in the cyclone type dust collector of FIG. 4.
Figure 7:
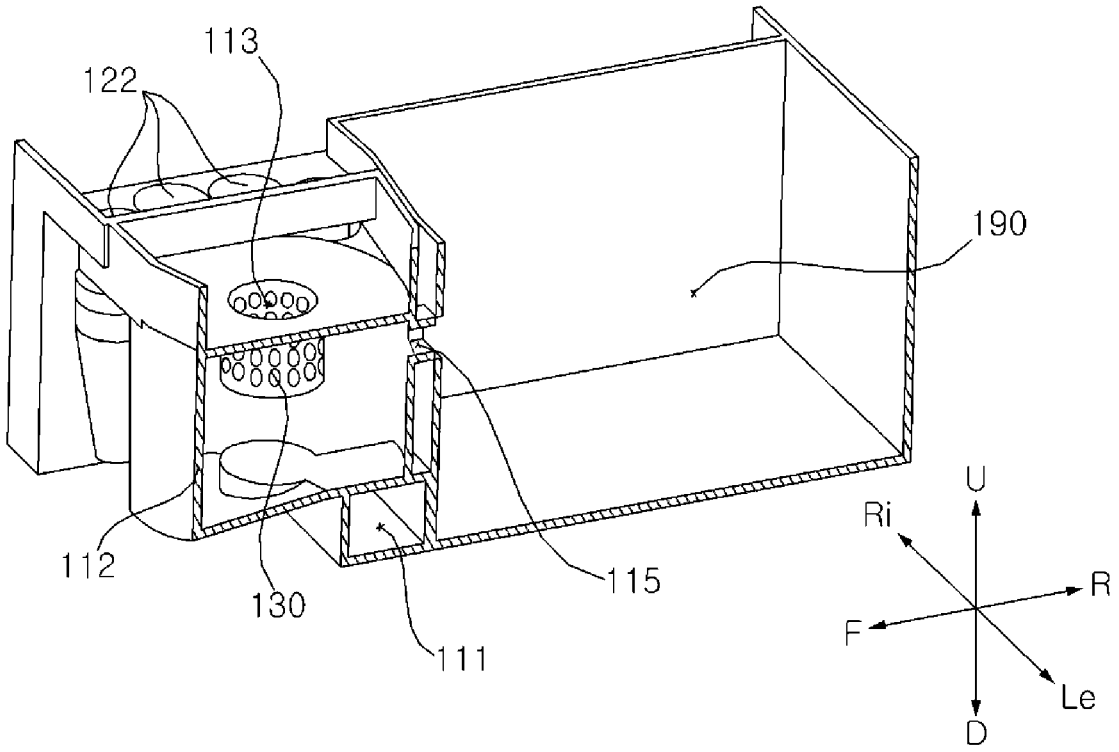
FIG. 7 is a cross-sectional perspective view of the cyclone type dust collector of FIG. 4 taken along a direction different from FIG. 5.

The second cyclone 120 may be arranged inside or outside the first cyclone body 112. FIG. 4 to FIG. 7 show that the second cyclone 120 is provided outside the first cyclone. Referring to FIG. 6B, the air flow of the cyclone type dust collector 100 of the present embodiment will be described.

Air may be supplied through the first air inlet 111 located in the lower portion of the first cyclone body 112. The air supplied through the first air inlet 111 may cyclonically flow upward in the first cyclone body 112, so that the dust is separated. The separated dust may be collected in the first dust container 190 through the first dust outlet 115 located in the upper portion of the first cyclone body 112. The dust-separated air may then be discharged through the first air outlet 113.

The air discharged through the first air outlet 113 may be supplied to the second air inlet 121 through the connection space 135. The air supplied to the second air inlet 121 may be supplied to the inside of the second cyclone body 122 while being downwardly rotated by the guide vane 126 so that the dust is separated. The separated dust may be collected in the second dust container 129 through the second dust outlet 125. The dust-separated air may then be discharged through the second air outlet 123.

Figure 4:
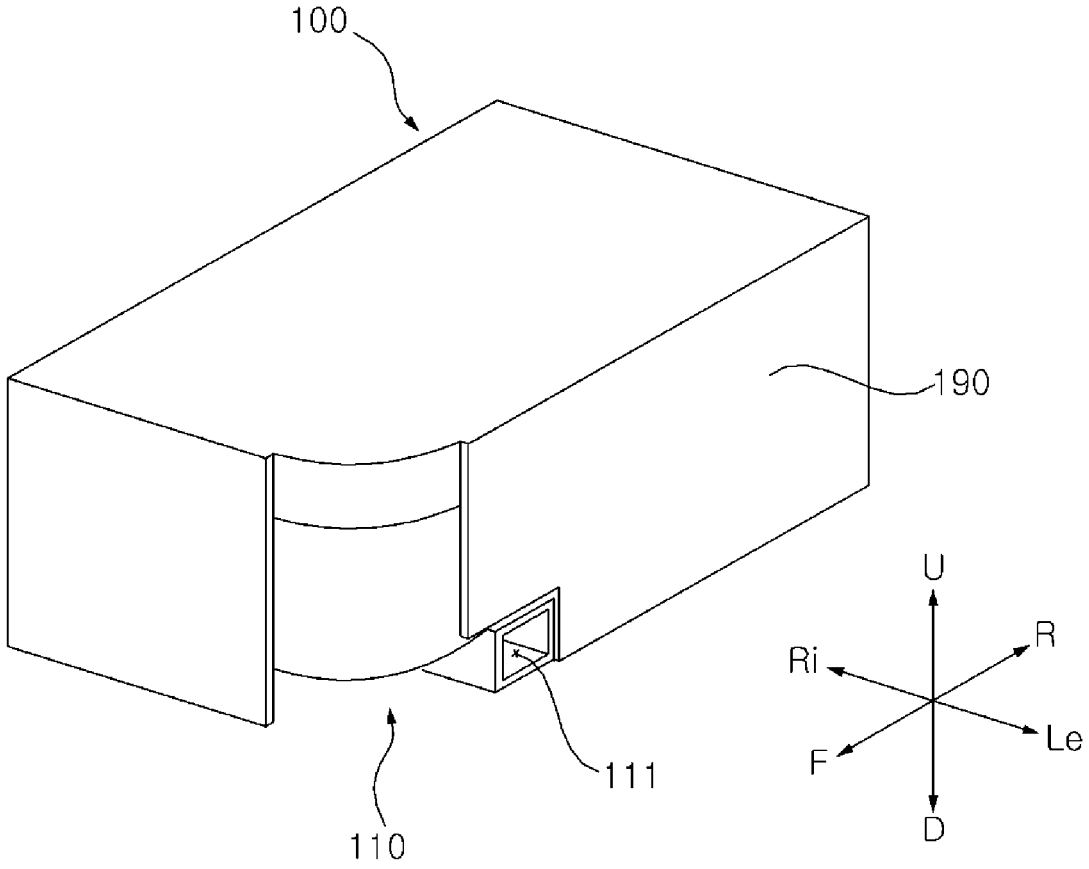
FIG. 4 is a perspective view of a cyclone type dust collector according to an embodiment.
Figure 5:
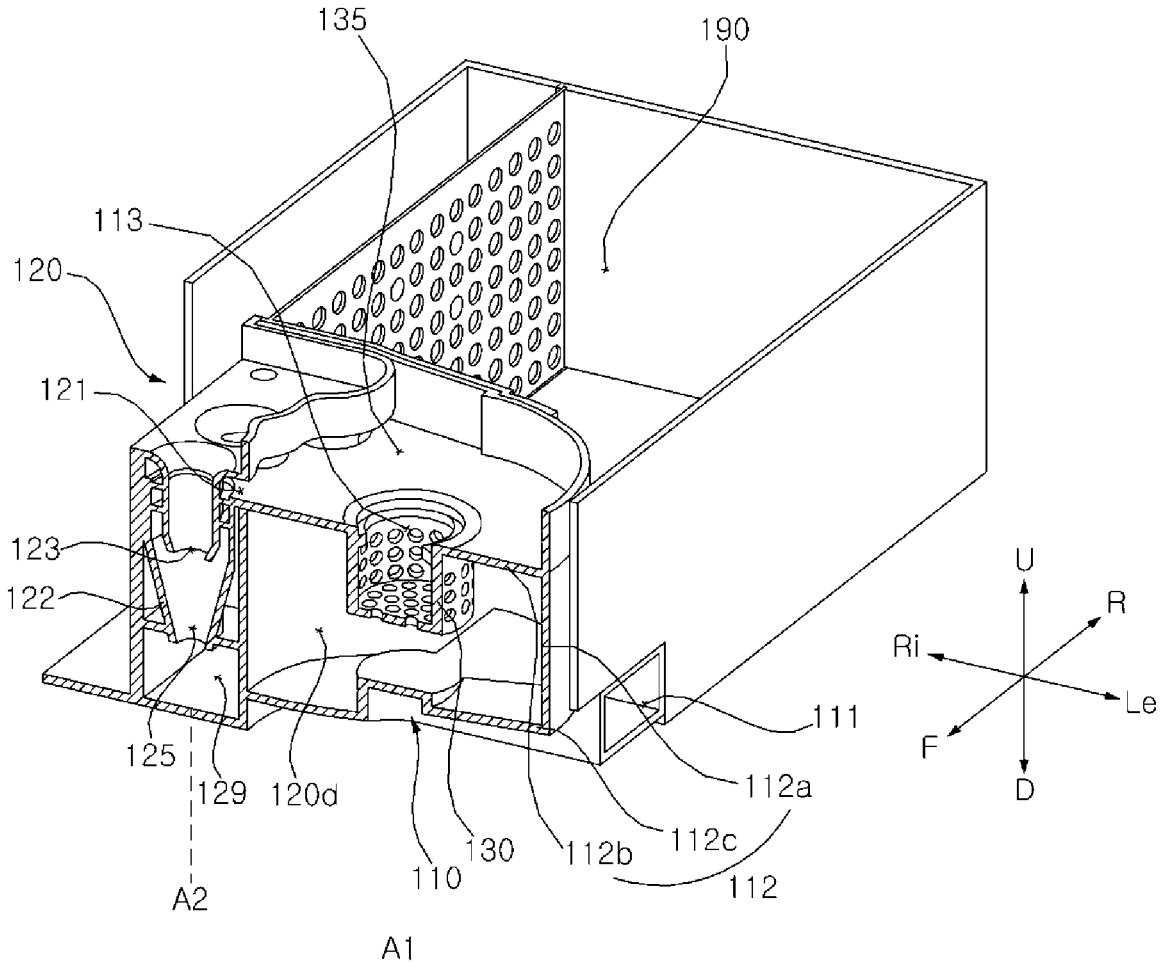
FIG. 5 is a cross-sectional perspective view of the cyclone type dust collector of FIG. 4.

The cyclone type dust collector 100 according to another embodiment may differ from the embodiment of FIG. 4 in that the second cyclone 120 is located inside the first cyclone 110. When the second cyclone 120 is located inside the first cyclone 110, an area on the plane occupied by the cyclone type dust collector 100 may be reduced.

Figure 8:
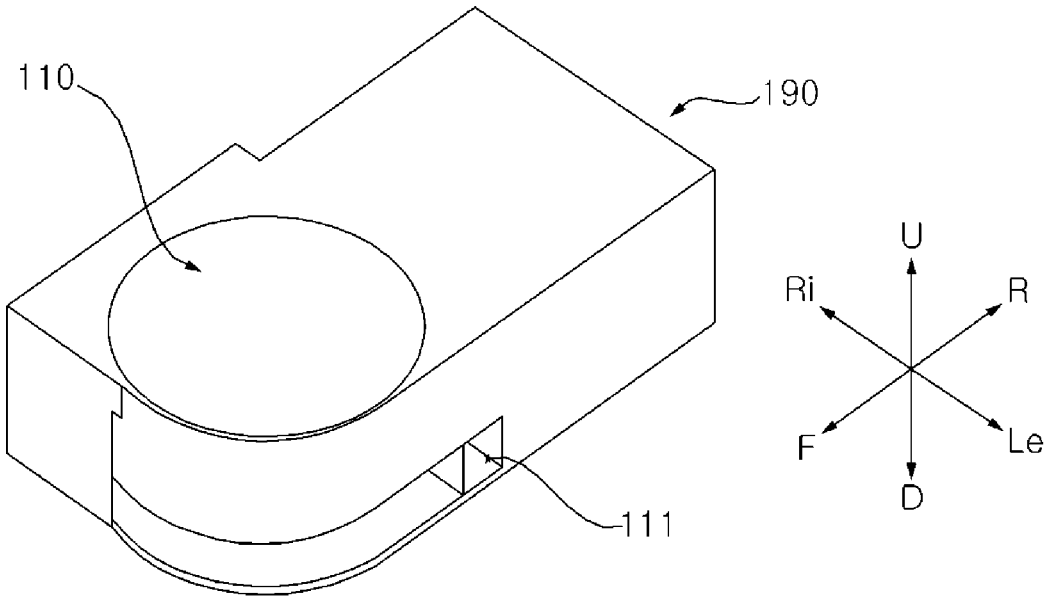
FIG. 8 is a perspective view of a cyclone type dust collector according to another embodiment.
Figure 9:
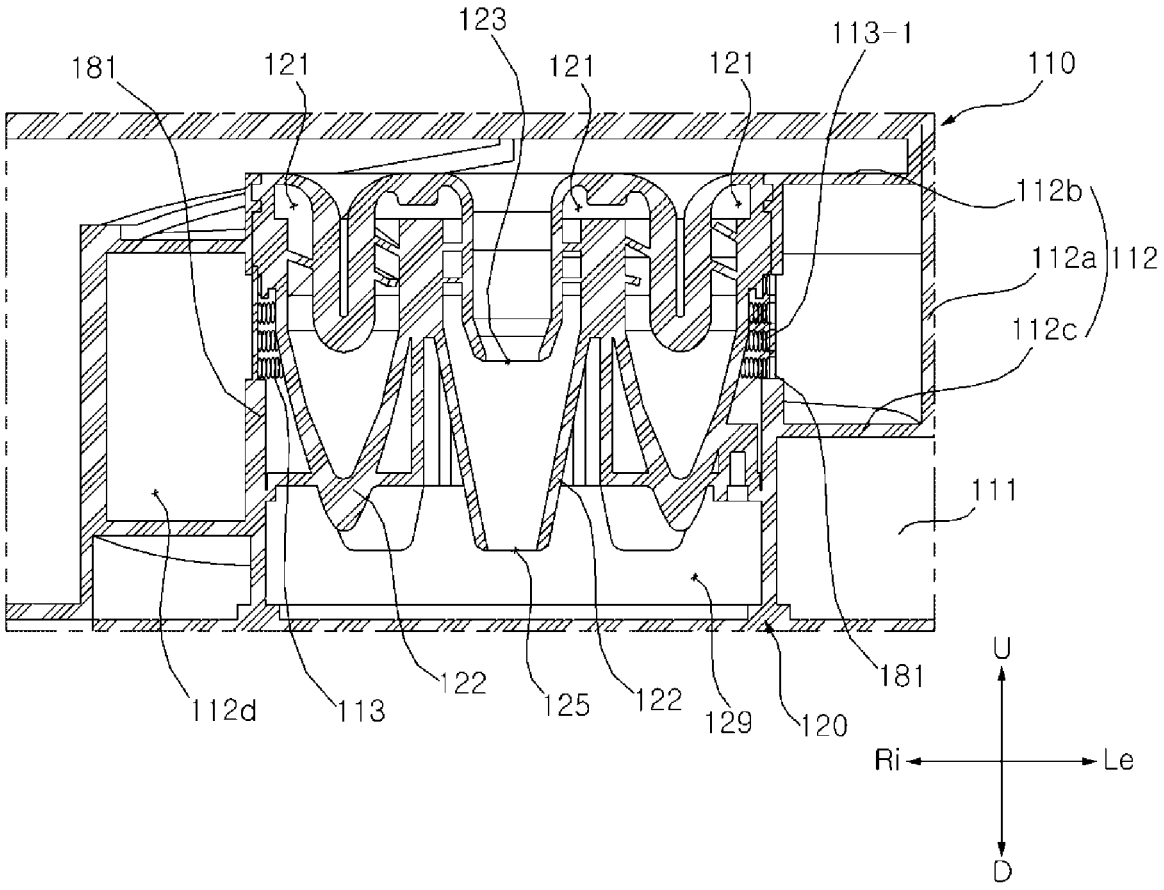
FIG. 9 is a cross-sectional view of the cyclone type dust collector of FIG. 8.
Figure 10:
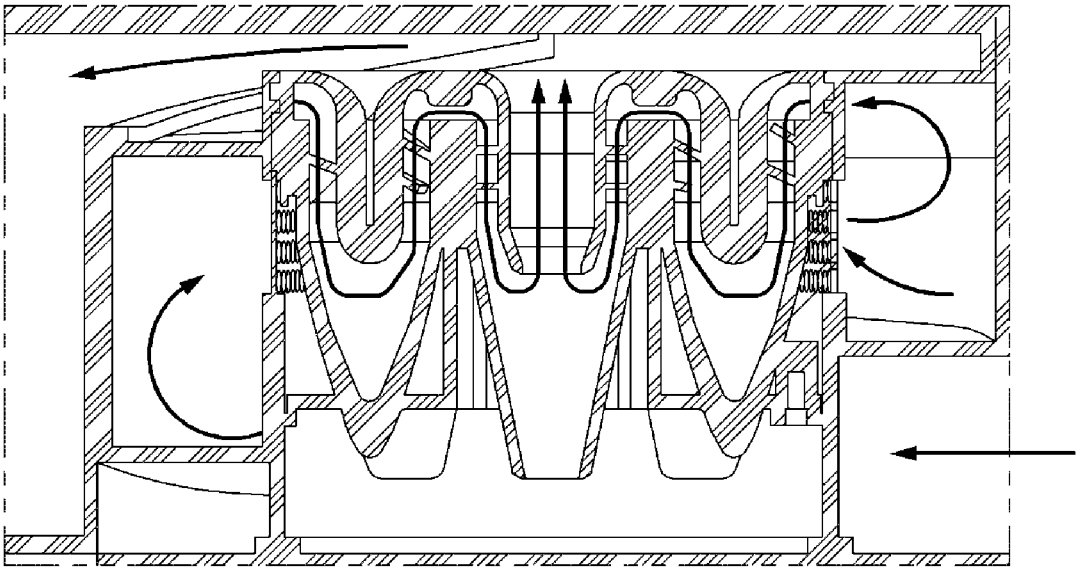
FIG. 10 illustrates a flow of air in the cyclone type dust collector of FIG. 8.

Referring to FIG. 8 to FIG. 10, in the cyclone type dust collector 100 according to another embodiment, the second cyclone 120 and the second dust container 129 may be located inside the first cyclone body 112. The second dust container 129 may be connected to the lower portion of the second cyclone 120 and the combined height of the second cyclone 120 and the second dust container 129 may be equal to the height of the first cyclone body 112, or may be lower than the height of the first cyclone body 112.

A plurality of second cyclones 120 may be provided, and the second air outlet 123 of any one of the plurality of second cyclones 120 may be provided in the first flow axis A1. A boundary body 181 may be provided inside the circumferential surface 112*a* of the first cyclone body 112 to surround the first flow axis A1. The boundary body 181 may define a space in which the second cyclone 120 and the second dust container 129 are located inside the first cyclone body 112, and may form a part of the second dust container 129.

The boundary body 181 may define a circumference which surrounds the first flow axis A1, and may define the flow space 112*d* in the first cyclone body 112. The upper end of the boundary body 181 may be connected to the upper cover 112*b* and the lower end of the boundary body 181 may be connected to the lower cover 112*c*.

The boundary body 181 may include a first air outlet 113-1. The first air outlet 113-1 may be defined as a plurality of holes. The first air outlet 113-1 may be provided in the upper area of the boundary body 181.

At least one second cyclone 120 and second dust container 129 may be provided in or at an inner space defined by the boundary body 181. The second dust outlet 125 may be located lower than the first dust outlet 115 and the first air outlet 113-1.

Air may be supplied through the first air inlet 111 located in the lower portion of the first cyclone body 112. The air supplied through the first air inlet 111 may perform a spiral movement of rotating while moving upward in the first cyclone body 112, so that the dust may be separated from the air. The separated dust may be collected in the first dust container 190 through the first dust outlet 115 located in the upper portion of the first cyclone body 112. The dust-separated air may then be discharged through the first air outlet 113-1 formed in the boundary body 181.

The air discharged through the first air outlet 113-1 may be supplied to the second air inlet 121. The air supplied to the second air inlet 121 may be supplied to the inside of the second cyclone body 122 while rotating downward by the guide vane 126 so that the dust may be separated. The separated dust may be collected in the second dust container 129 through the second dust outlet 125. The dust-separated air may be discharged through the second air outlet 123.

As described above, dust collection efficiency may be maintained while implementing a slim design having a low height. In addition, a space having a low height such as a space between furniture and a floor surface may be easily cleaned. In addition, the dust container may overlap outside the cyclone in the horizontal direction so that the size of the dust container may be freely changed irrespective of the capacity and shape of the cyclone.

Further, dust collection efficiency may be maintained, even if the air inlet of the cyclone is arranged below the air outlet and the dust outlet so that the dust container is not provided below the cyclone.

A cyclone type dust collector may include a first cyclone comprising a first cyclone body configured to generate a cyclone flow around a flow axis extending in a vertical direction, a first air inlet formed in the first cyclone body, a first dust outlet formed in the first cyclone body, and a first air outlet formed in the first cyclone body; and a first dust container configured to communicate with the first dust outlet and collect dust, wherein at least a part of the first cyclone body is disposed to overlap with the first dust container in a first direction intersected with the flow axis. The first air inlet may be provided below the first dust outlet.

The first air outlet may be provided above the first air inlet. The first air outlet may be provided above the first dust outlet. The first air inlet and the first dust outlet may be formed in a circumferential surface of the first cyclone body, and the first air outlet may be formed in an upper cover connected to an upper end of the circumferential surface of the first cyclone body.

The cyclone type dust collector may further include a mesh cone provided between an interior of the first cyclone body and the first air outlet. The cyclone type dust collector may further include at least one second cyclone configured to perform a cyclone flow for an air discharged from the first cyclone around a flow axis extending in a vertical direction; and a second dust container provided below the second cyclone to collect dust collected in the second cyclone.

At least a part of the second cyclone and the second dust container may overlap with the first dust container in the first direction. At least a part of the second cyclone and the second dust container may overlap with the first cyclone body in a second direction intersected with the first direction and the flow axis.

The second cyclone may include a second cyclone body configured to generate a cyclone flow around a flow axis extending in a vertical direction, a second air inlet formed in the second cyclone body, a second dust outlet formed in the second cyclone body, and a second air outlet formed in the second cyclone body. The second air inlet may communicate with the first air outlet and may be located higher than an upper end of the first cyclone body.

The second air outlet and the second air inlet may be provided above the second dust outlet. The cyclone type dust collector may further include a guide vane which is connected to the second cyclone body and guides air introduced from the second air inlet. The guide vane may form at least a part of a spiral orbit around a flow axis of the second cyclone body.

The second cyclone and the second dust container may be located inside the first cyclone body. At least a part of the second cyclone and the second dust container may overlap with the first dust container in the first direction.

A cyclone type dust collector may include a first cyclone configured to perform a cyclone flow for an introduced air around a flow axis extending in a vertical direction; a first dust container configured to collect dust collected in the first cyclone; at least one second cyclone configured to perform a cyclone flow for air discharged from the first cyclone around a flow axis extending in a vertical direction; and a second dust container which is disposed below the second cyclone and collects dust collected in the second cyclone, wherein the first cyclone, the second cyclone, and the second dust container are disposed to overlap with the first dust container in a first direction intersected with the flow axis.

A cleaner may include a cleaner main body; a cyclone type dust collector disposed in the cleaner main body; and a wheel configured to move the cleaner main body, wherein the cyclone type dust collector comprises: a first cyclone comprising a first cyclone body configured to generate a cyclone flow around a flow axis extending in a vertical direction, a first air inlet formed in the first cyclone body, a first dust outlet formed in the first cyclone body, and a first air outlet formed in the first cyclone body; and a first dust container configured to communicate with the first dust outlet and collect dust, wherein at least a part of the first cyclone body is disposed to overlap with the first dust container in a first direction intersected with the flow axis.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a cleaner main body;

a dust collector provided in the cleaner main body; and at least one wheel configured to allow the cleaner main body to move, wherein the dust collector comprises:

a first cyclone comprising a first cyclone body configured to generate a cyclonic flow of air around a first flow axis that extends in a vertical direction, a first air inlet formed in the first cyclone body, a first dust outlet formed in the first cyclone body, and a first air outlet formed in the first cyclone body; and a first dust container configured to communicate with the first dust outlet and collect dust separated from the air, wherein at least a part of the first cyclone body is horizontally adjacent to the first dust container in a first horizontal direction that intersects with the first flow axis, wherein the first air outlet is provided above the first air inlet, wherein the first air inlet and the first dust outlet are formed in a circumferential surface of the first cyclone body, and wherein the first air outlet is formed in an upper cover that is connected to an upper end of the circumferential surface of the first cyclone body and covers a top of the first cyclone, at least one second cyclone configured to induce a cyclonic flow of air discharged from the first cyclone around a second flow axis extending in the vertical direction; and a second dust container provided below the at least one second cyclone to collect dust removed from the air in the at least one second cyclone, wherein at least a part of the at least one second cyclone and the second dust container are horizontally adjacent to the first dust container in the first horizontal direction, wherein at least a part of the at least one second cyclone and the second dust container are horizontally adjacent to the first cyclone body in a second horizontal direction that intersects with the first horizontal direction and the first flow axis, wherein the second cyclone and the second dust container are arranged outside the first cyclone body, wherein a bottom wall of the first cyclone body is connected to and is not removable with respect to a side wall of the first cyclone body.

2. A dust collector comprising:

a first cyclone comprising a first cyclone body configured to induce a cyclonic flow of air around a first flow axis that extends in a vertical direction, a first air inlet formed in the first cyclone body, a first dust outlet formed in the first cyclone body, and a first air outlet formed in the first cyclone body;

a first dust container configured to communicate with the first dust outlet and collect dust separated from the air, wherein at least a part of the first cyclone body is horizontally adjacent to the first dust container in a first horizontal direction that intersects with the first flow axis, wherein the first air outlet is provided above the first air inlet, wherein the first air inlet and the first dust outlet are formed in a circumferential surface of the first cyclone body, and wherein the first air outlet is formed in an upper cover that is connected to an upper end of the circumferential surface of the first cyclone body and covers a top of the first cyclone;

at least one second cyclone configured to induce a cyclonic flow of air discharged from the first cyclone around a second flow axis extending in the vertical direction; and a second dust container provided below the at least one second cyclone to collect dust removed from the air in the at least one second cyclone, wherein at least a part of the at least one second cyclone and the second dust container are horizontally adjacent to the first dust container in the first horizontal direction, wherein at least a part of the at least one second cyclone and the second dust container are horizontally adjacent to the first cyclone body in a second horizontal direction that intersects with the first horizontal direction and the first flow axis, wherein the second cyclone and the second dust container are arranged outside the first cyclone body, wherein a bottom wall of the first cyclone body is connected to and is not removable with respect to a side wall of the first cyclone body.

3. The dust collector of claim 2, wherein the first air inlet is provided below the first dust outlet.

4. The dust collector of claim 2, wherein the first air outlet is provided above the first dust outlet.

5. The dust collector of claim 2, further comprising a particle trap provided between an interior of the first cyclone body and the first air outlet.

6. The dust collector of claim 2, wherein the at least one second cyclone comprises a second cyclone body configured to induce the cyclonic flow of air around the second flow axis extending in the vertical direction, a second air inlet formed in the second cyclone body, a second dust outlet formed in the second cyclone body, and a second air outlet formed in the second cyclone body.

7. The dust collector of claim 6, wherein the second air inlet communicates with the first air outlet and is located higher than an upper end of the first cyclone body.

8. The dust collector of claim 6, wherein the second air outlet and the second air inlet are each arranged above the second dust outlet.

9. The dust collector of claim 6, further comprising a guide vane which is connected to the second cyclone body and guides the air introduced from the second air inlet.

10. The dust collector of claim 9, wherein the guide vane forms at least a part of a cyclonic flow path around the second flow axis of the second cyclone body.

* * * * *